US005613598A

United States Patent [19]

Pittman et al.

[11] Patent Number: 5,613,598

[45] Date of Patent: Mar. 25, 1997

[54] SWITCH MOUNTING

[75] Inventors: Bryan A. Pittman, Atwater; Thomas D. Williams, Hudson, both of Ohio

[73] Assignee: Delta Systems, Inc., Streetsboro, Ohio

[21] Appl. No.: 559,297

[22] Filed: Nov. 15, 1995

[51] Int. Cl.[6] ..... H01H 13/04

[52] U.S. Cl. ..... 200/295; 248/223.41

[58] Field of Search ..... 200/294, 295; 248/223.41, 224.8

[56] References Cited

U.S. PATENT DOCUMENTS

| | | | |
|---|---|---|---|
| 3,670,118 | 6/1972 | Stowe | 200/295 X |
| 3,708,642 | 1/1973 | Hollingsead et al. | 200/295 |
| 4,535,534 | 8/1985 | Ohashi et al. | 200/294 X |
| 4,812,604 | 3/1989 | Howard . | |
| 4,862,325 | 8/1989 | Ohashi | 200/295 X |

FOREIGN PATENT DOCUMENTS

| | | | |
|---|---|---|---|
| 3347295 | 7/1985 | Germany | 200/295 |

*Primary Examiner*—Renee S. Luebke
*Attorney, Agent, or Firm*—Watts, Hoffmann, Fisher & Heinke Co. L.P.A.

[57] ABSTRACT

A switch housing having elongated side walls and an end wall that defines a housing interior. Conductive switch terminals supported within the housing interior extend outside the switch housing for connection to an external circuit. A switch actuator extends through the end wall of the switch housing and is supported by the switch housing for movement along a travel path to control an actuation state of said switch by selectively shorting the conductive switch terminals. A housing cover encloses the housing interior and includes openings to allow the terminals to extend from the housing interior to connect to the external circuit. The cover supports the switch housing in a selected one of two different orientations on a support surface. A retainer coupled to the housing cover has a retaining surface spaced from one wall of the housing cover by a gap that permits the retainer to slide over a tab coupled to the support surface to which the switch housing is mounted. A latch member attached to the retainer by a flexible connection permits the latch member to flex as the retainer is pushed over the tab. The latch member has a projection coupled to the latch member that fits into an opening in the tab for inhibiting further relative movement between the tab and the switch housing in one of said two orientations.

8 Claims, 5 Drawing Sheets

SWITCH MOUNTING

FIELD OF THE INVENTION

The present invention concerns an electrical switch and more particularly concerns switch mounting structure that enables the switch to be mounted in one of two orientations relative to a support surface.

BACKGROUND ART

One prior art technique for mounting a switch housing is to provide a housing flange having apertures through which connectors can be inserted to mount the switch housing to a support surface. Delta Systems of Streetsboro, Ohio, assignee of the present invention, sells a prior art push button plunger switch designated as model number 6400 that utilizes such a mounting technique. This prior art switch includes a switch body or housing supporting two spaced apart switch terminals that are selectively bridged by a conductive contact carried by a moveable actuator.

When mounting the prior art switch housing to a support, a support surface is prepared by drilling two holes into the support surface and then aligning the holes of the housing flange with the two holes in the support surface. Connectors are then pushed through the flange and attached to the support surface to fix the switch housing to the support surface.

The prior art switch housing is relatively simple to install, but does require use of a tool to mount the housing to the support surface. Furthermore, the orientation of the switch housing relative to the mounting surface can be changed but with the result that the switch housing is in a different position relative the support surface for the two different mounting orientations.

DISCLOSURE OF THE INVENTION

A new and improved switch constructed in accordance with the present invention includes a switch housing supporting conductive switch terminals within a switch housing interior. A switch actuator extends through a side wall of the switch housing and is supported by the switch housing for movement along a travel path to control an actuation state of said switch by selectively shorting the conductive switch terminals.

A housing support mounts the switch housing in a selected one of two different orientations on a support surface. The housing support includes a retainer coupled to the switch housing having a retaining surface spaced from one wall of the switch housing by a gap that permits the retainer to slide over a mounting tab coupled to a switch support surface. A latch member attached to the retainer by a flexible connection permits the latch member to flex as the retainer is pushed over the tab. A projection coupled to the latch member fits into an opening in the tab for inhibiting further relative movement between the tab and the switch housing in one of the two orientations.

The invention allows the a switch housing to be mounted without special tools and furthermore occupies the same general region of the support surface regardless of which of the two housing orientations is selected.

In accordance with the invention the mounting tab has a specially configured opening that engages the projection in the housing support differently depending on the orientation of the opening. This defines the proper orientation of switch mounting since in one orientation the projection fits into the opening but will also rather easily slide out of the opening. In the other orientation the projection fits into the opening in such a way that ridges that bound the projection contact side walls of the opening to inhibit movement of the switch housing away from its installed position.

From the above it is seen that one object of the invention is the simple installation of a switch housing in one of two orientations without resort to special tools and in a way that allows the housing to be removed and replaced without resort to tools. This and other objects, advantages and features of the invention will be described in conjunction with a detailed description of a best mode for practicing the invention.

BEST MODE FOR PRACTICING THE INVENTION

Figures 1, 2:
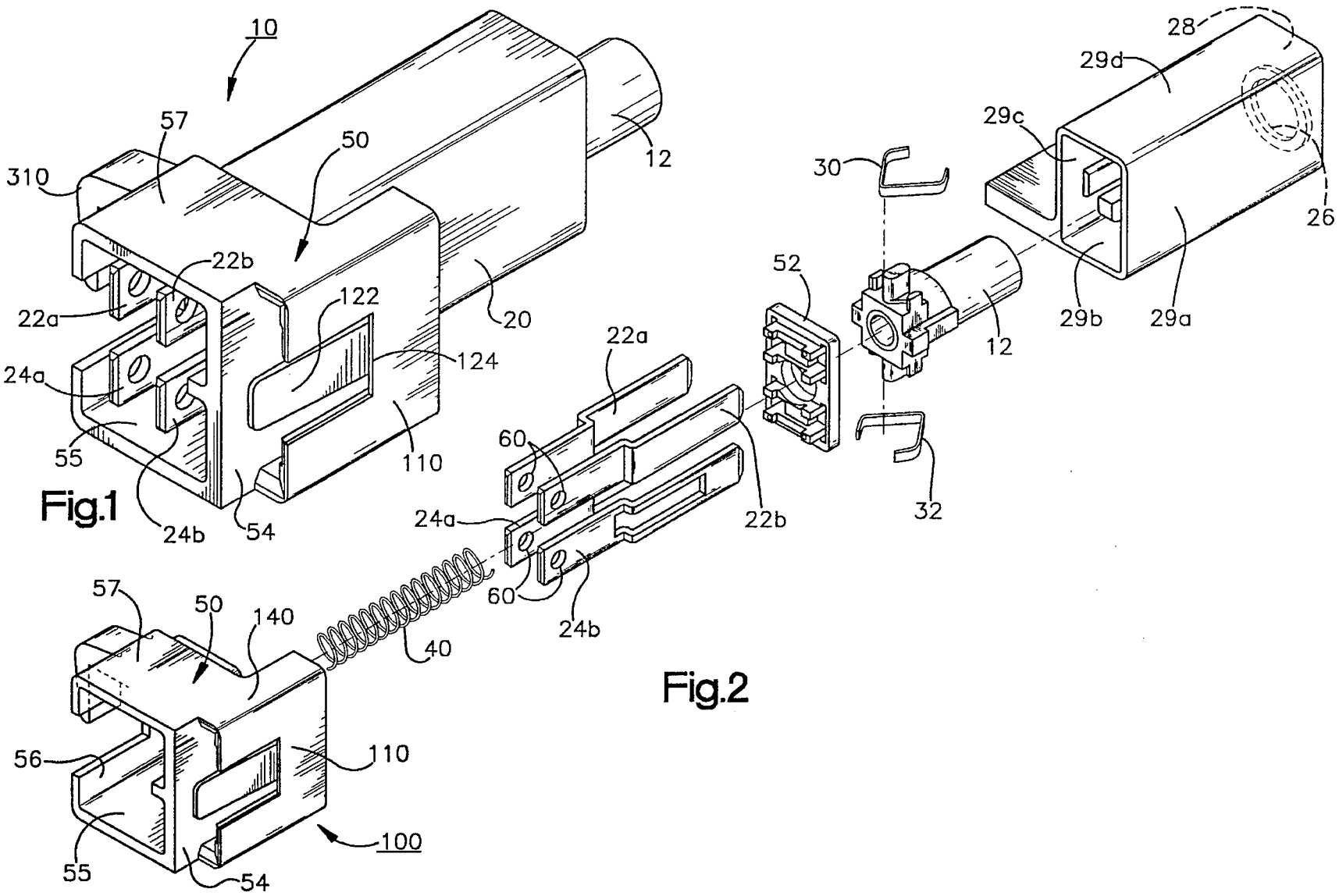
FIG. 1 is perspective view of a switch constructed in accordance with the invention.
FIG. 2 is an exploded perspective view of the FIG. 1 switch showing components that are mounted within a switch housing.

The drawings illustrate a switch 10 for opening and closing an electrical circuit (not shown) in response to movement of a switch actuator 12. FIG. 1 is a perspective view of a completed switch and FIG. 2 is a perspective view of the components of the switch before the switch is assembled. The switch 10 includes a switch housing 20 supporting two pairs of conductive switch terminals. A first pair of terminals 22*a*, 22*b* are a normally open set of terminals and a second pair of terminals 24*a*, 24*b* are a normally closed set of terminals. The switch actuator 12 extends through an opening 26 in an end wall 28 of the switch housing 20. The actuator is supported by four side walls 29*a*–29*b* of the switch housing 20 for movement along a generally linear travel path to control an actuation state of the switch 10 by selectively shorting together the conductive switch terminals 22*a*, 22*b*, 24*a*, 24*b*.

Inside the housing interior the actuator 12 supports two switch contacts 30, 32 that selective bridge or short an associated set of terminals. As an example, the switch contact 30 bridges the terminals 22*a*, 22*b* when the actuator is pushed into the housing 20 and the contact 32 moves out of electrical engagement with the terminals 24*a*, 24*b* when the actuator 12 is pushed into the housing. A spring 40 is trapped between a switch cover 50 and a moveable plate 52 and acts to bias the actuator through the opening 26.

The cover 50 is a separately molded plastic member that has four side walls 54–57 that are generally parallel to the walls 29*a*–29*d* and further includes an end wall 58. The cover 50 is connected to the housing 20 by ultrasonic welding. As seen in FIGS. 1 and 2, the switch terminals include portions that extend through openings 59 in the cover's end wall 58. Exposed portions of the switch terminals are coupled to an exterior circuit. Holes 60 in the terminals facilitate the connection of the terminals to the external circuit. A cone shaped post 61 extends away from the wall 58 to center the spring 40 inside the housing 20.

Figure 8:
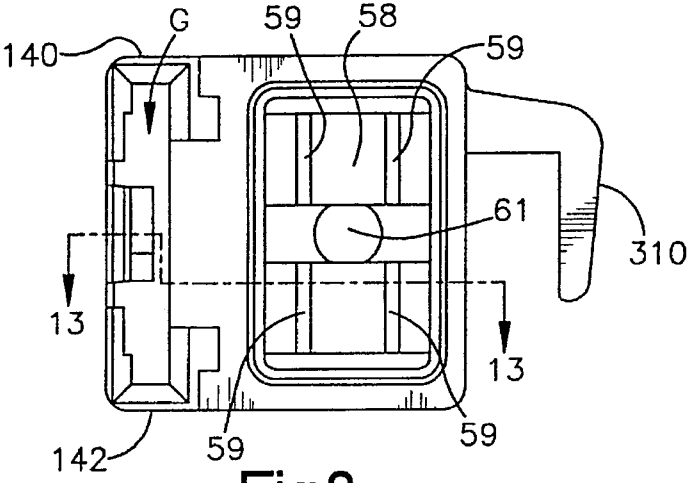
FIG. 8 is an end elevation view of the switch cover shown in FIG. 7.
Figure 10:
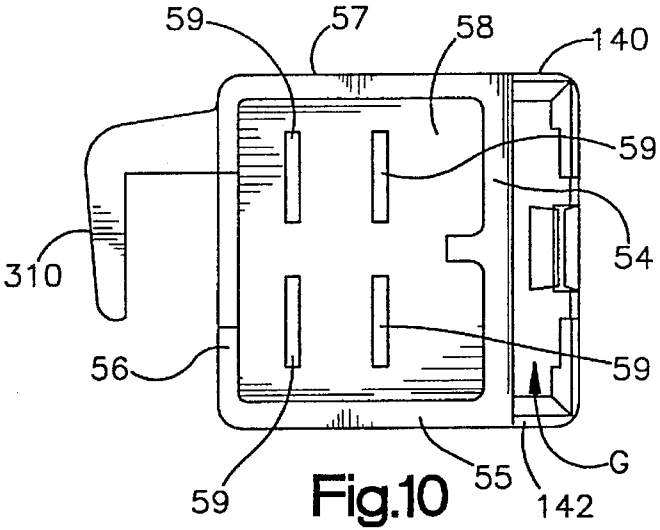
FIG. 10 is a second end elevation view of the switch cover of FIG. 7.
Figure 7:
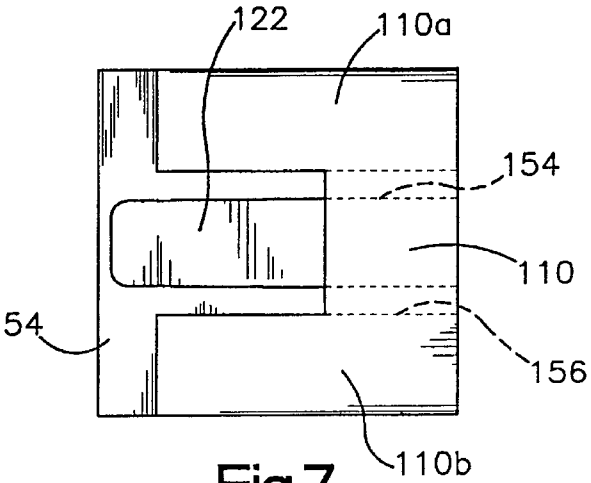
FIG. 7 is a side elevation view of a switch cover that forms part of the FIG. 1 housing.
Figure 9:
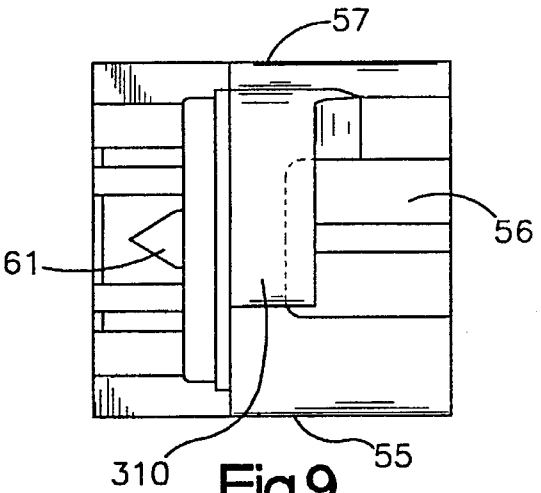
FIG. 9 is a second side elevation view of the switch cover of FIG. 7.
Figure 12:
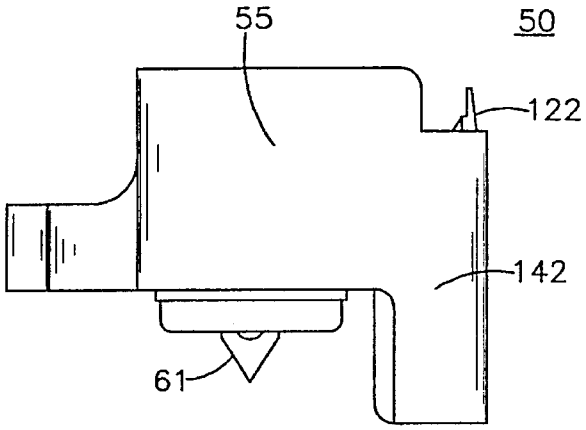
FIGS. 11 and 12 are two additional side elevation views of the switch cover shown in FIG. 7.

The housing cover 50 mounts the switch housing in a selected one of two different orientations on a support surface 62. A retainer 100 attached to the cover 50 has a retaining wall 110 oriented generally parallel to one side wall 54 of the cover and defines a throughslot that slips over a mounting tab. A gap G (FIGS. 8 and 10) between the retainer wall 110 and the side wall 54 allows the retainer 100 to slide over a tab connected to the support surface 62 to fix the housing to the support surface 62. Two different tabs 120*a*, 120*b* are shown in the Figures and the differences between these two tabs is described below.

Figure 13:
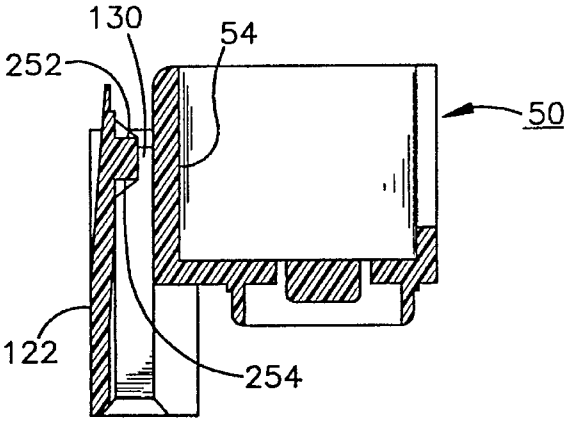
FIG. 13 is a section view of the switch cover as seen from the plane 13—13 in FIG. 8.

An elongated latch member 122 is attached to the retainer wall 110 by a flexible hinge 124 that permits the latch member 122 to flex as the retainer is pushed over the tab 120*a* (or 120*b*). The latch member 122 has an inwardly facing projection 130 (FIGS. 13, 14) that fits into an opening in its associated tab for inhibiting further relative movement between the tab and the switch housing. The latch member 122 most preferably defines an elongated finger which supports the projection 130. On either side of the latch member 122 the retainer 100 has first and second walls 140, 142 that extend out perpendicularly from the side wall 54 of the switch cover 50. This spaces the wall 54 and the latch member 122 by the gap G equal to the width of said first and second walls 140, 142. In a preferred embodiment of the invention the retainer 100 and cover 50 are integrally molded to form a single member.

Figure 14:
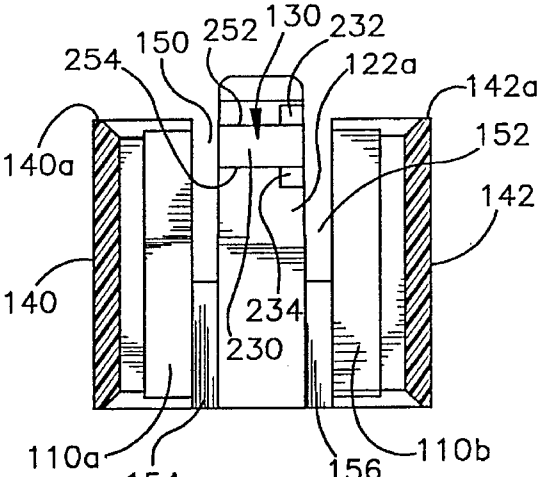
FIG. 14 is a section view of the switch cover as seen from the plane 14—14 in FIG. 11.
Figure 11:
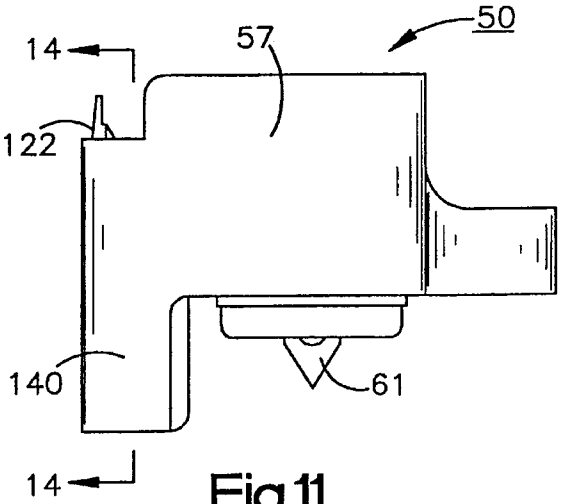

Turning to FIG. 14, one sees the wall 110 constructed from two sections 110*a*, 110*b* spaced from the flexing portion of the latch 122 by two cutouts 150, 152. Two grooves 154, 156 on an inner surface of the wall 110 reduce the wall thickness and make the latch flex more easily in the region of the hinge 124.

Figure 6:
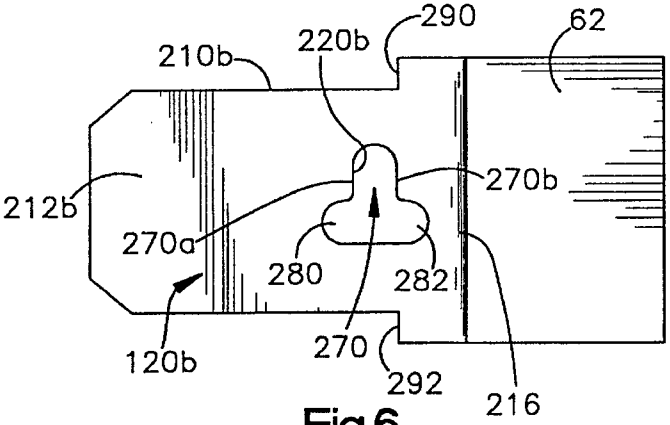
FIG. 6 is a plan view of the mounting tab as seen from the plane 6—6 in FIG. 5.
Figure 4:
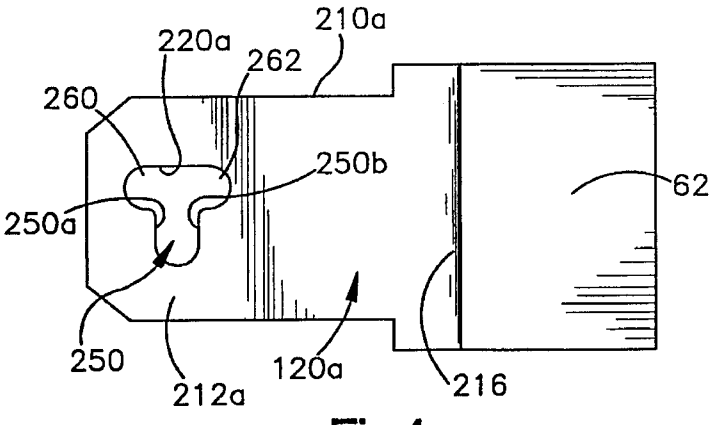
FIG. 4 is a plan view of the mounting tab as seen from the plane 4—4 in FIG. 3.

FIGS. 4 and 6 illustrate two different tabs 120*a*, 120*b* for use in mounting the switch 10. The retainer 100 works with either of the two tabs 120*a*, 120*b* and the choice of the tab determines the orientation of the installed switch.

Each mounting tab is connected to an associated support 62 for supporting the switch housing which most preferably is fabricated from sheet metal. The tab 120*a* has an elongated tab portion 210*a* having a generally planar exposed surface 212*a* that is parallel to the flat mounting surface 62. The tab is most preferably formed when the member that defines the support 62 is being fabricated. A metal stamping is stamped with a die to form an outline of the tab. The tab is either bent away from the support 62 as the stamping is performed or is bent on a separate fixture. Regardless of how it is bent, an intermediate tab portion 216 bends away from the generally planar surface of the support 62 and connects the planar tab portion 210*a* to the support 62. The tab 120*b* shown in FIG. 6 has tab portions 210*b*, 216*b* and is formed in a similar manner. Although not shown in the drawings, since the support 62 is stamped from a piece of sheet metal to form a housing or the like, the surface of the support to which the tab is attached generally extends peripherally around the outside of the region of the tab.

The planar tab portion of each of the tabs 120*a*, 120*b* defines a depression in the surface 212*a*, 212*b* of said second tab portion. Most preferably the depressions in the two tabs 120*a*, 120*b* extend completely through the tab to form openings. A first "T" shaped opening 220*a* is depicted in the tab 120*a* in FIG. 4 and a second "T" shaped opening 220*b* is depicted in the tab 120*b* in FIG. 6.

Figure 15C:
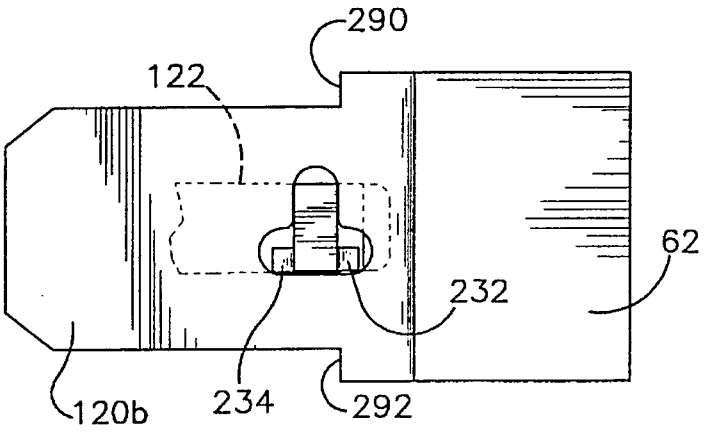
FIGS. 15A, 15B, and 15C are plan views of a mounting tab showing a retainer projection seated in a opening in the tab.
Figure 15A:
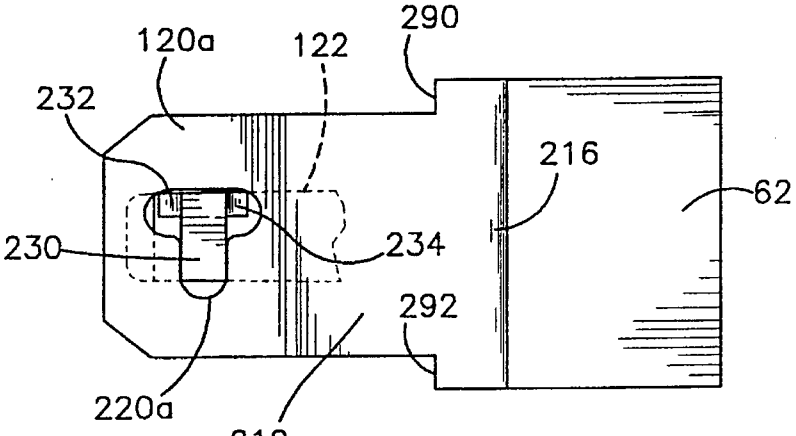
Figure 15B:
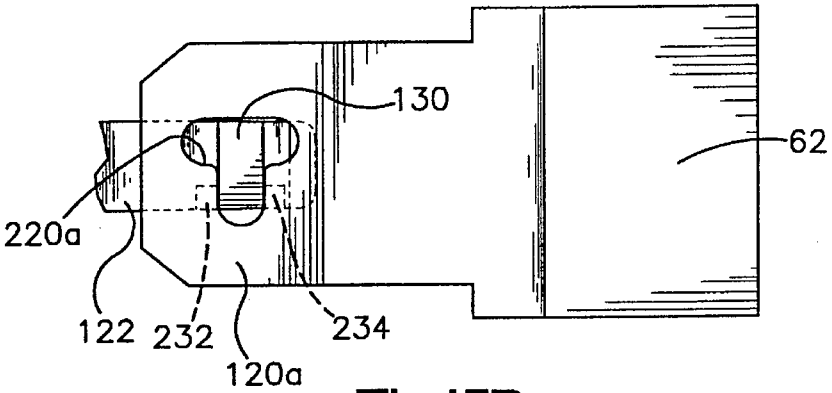

FIGS. 15A and 15B are plan views showing the opening 220*a* as seen from above the surface 212*a* with the projection 130 visible through the opening. The projection 130 has a center section that defines a plateau 230 and two outer portions that define generally symmetric ramp sections 232, 234 that extend upward from a surface 122*a* of the flexible latch 122.

Figure 3:
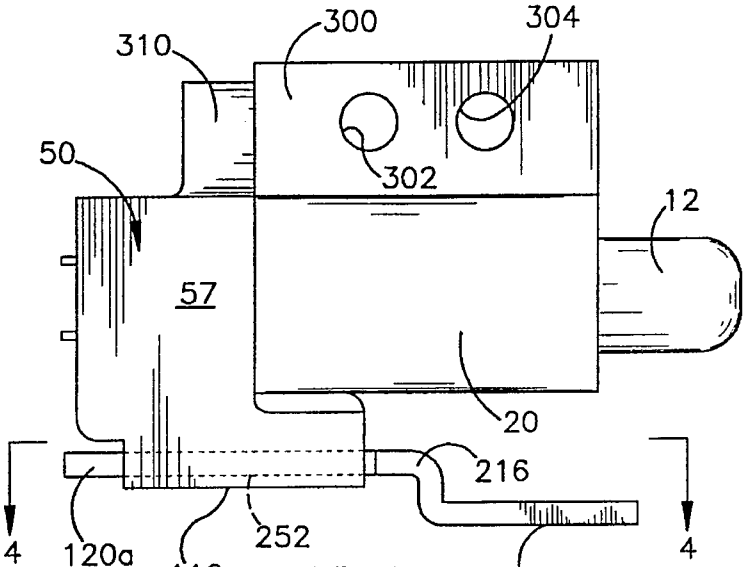
FIG. 3 is a side elevation view of the FIG. 1 switch housing showing the switch housing attached to a mounting tab formed in a switch support.

FIG. 15A illustrates a properly installed switch in the orientation of FIG. 3. The switch is grasped by an installer and the retainer 100 is slipped over the tab 120*a* until the projection 130 seats in the opening 220*a*. In the proper orientation of FIG. 15A the plateau section 230 extends into an elongated portion 250 of the opening. When seated in this manner, two side edges 252, 254 of the plateau abut sides 250*a*, 250*b* of the elongated or bottom portion of the "T" shaped opening. The two ramp portions 232, 234 of the projection seat within side lobes 260, 262 of the opening 220*a*. The engagement between the sides 250*a*, 250*b* lock the switch in place and inhibit relative movement between the switch and the tab.

FIG. 15B depicts an effort to mount the switch to the tab 120*a* with the switch rotated 180 degrees. As the projection 130 reaches the region of the opening 220*a* the plateau aligns with the elongated portion 250 of the opening. However, when the switch has been rotated 180 from its 'correct' orientation the ramp portions 232, 234 no longer fit within the side lobes 260, 262. Instead, the ramp portions 232, 234 rest against an inwardly facing surface 252 of the tab 120*a*. In this orientation the retainer 100 can be easily moved relative to the tab since the plateau is not trapped within the confines of the elongated portion 250 of the opening 220*a*.

Figure 5:
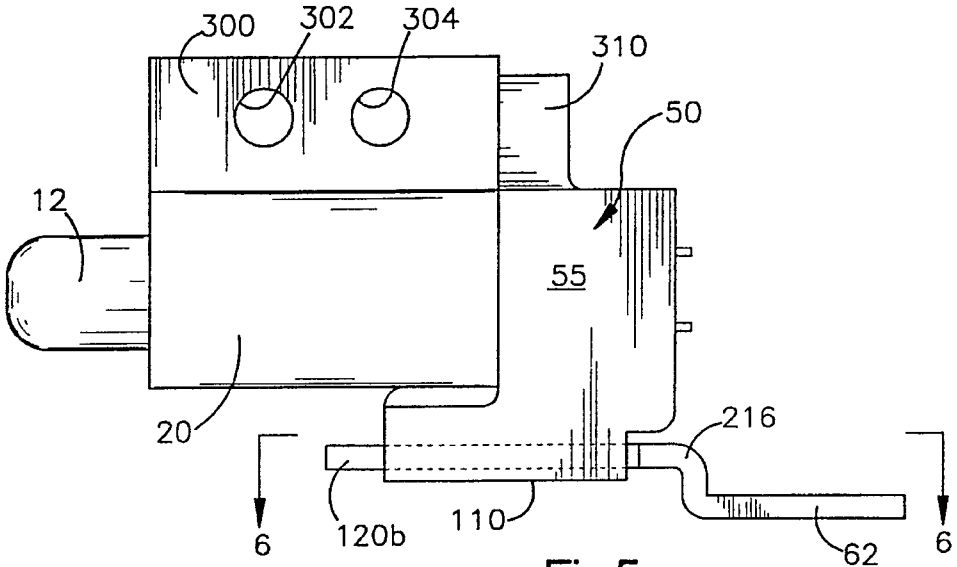
FIG. 5 is a side elevation view of the FIG. 1 switch housing showing the housing attached to a mounting tab for orienting the housing at an angle of 180 degrees from the housing orientation shown in FIG. 3.

FIG. 15C shows the projection 130 engaging the opening 220*b* if the switch 10 is installed in the orientation shown in FIG. 5. The switch is grasped by an installer and the retainer 100 is slipped over the tab 120*b* in the orientation shown in FIG. 5. The switch retainer slips over the tab 120*b* until the projection 130 seats in the opening 220*b*. In the proper orientation of FIG. 5 the plateau section 230 extends into an elongated portion 270 of the opening. When seated in this manner, the two side edges 252, 254 of the plateau 230 abut sides 270*a*, 270*b* of the elongated portion of the opening. The two ramp portions 232, 234 of the projection seat within side lobes 280, 282 of the opening 220*b*. The engagement between the sides 270*a*, 270*b* and the plateau 230 lock the switch in place and inhibit relative movement between the switch 10 and the tab 120*b*.

The mounting orientation shown in FIG. 5 is the preferred orientation since the movement inhibiting action of the projection/opening engagement is supplemented by engagement between the side walls 140, 142 and notches 290, 292 in the tab 120*b*. When installed in the orientation shown in FIG. 5, actuation of the switch by pressing the actuator 12 into the switch housing 20 tends to move the cover 50 so that ends 140*a*, 142*a* of the walls 140, 142 will abut the notches 290, 292. Thus, even if the switch actuation unseats the projection 130 from the opening 120*b*, contact between the walls and the notches will stop more than a limited amount of switch movement.

For the mounting tab 120*b* there can be no incorrect mounting since the switch cannot be pushed over the tab 120*b* far enough to improperly seat the projection within the opening 220*b*. Before this happens the walls 140, 142 will abut the notches 290, 292.

Note, the added safeguard against relative movement is not available in the FIG. 3 mounting orientation since depressing the actuator 12 into the housing 20 tends to move the switch away from the notches 290, 292 in the tab.

As seen in the Figures the housing 20 includes an integral flange 300 having openings 302, 304 that enable the switch 10 to be mounted in the manner described in the background section of the present specification. An additional feature of the cover 50 is the inclusion of a finger-like guide 310 that extends away from the wall 56 and is used to route conductors (not shown) away from the exposed portions of the switch terminals. Typically, the conductors are attached and routed beneath the guide 310 before the switch is mounted to the support 62.

A preferred embodiment of the present invention has been described with a degree of particularity. It is the intent, however, that the invention include all modifications and alterations from the disclosed design falling within the spirit or scope of the appended claims.

We claim:

1. Switch apparatus comprising:

a) a switch housing supporting conductive switch terminals within a switch housing interior;

b) a switch actuator that extends through a wall of the switch housing and is supported by the switch housing for movement along a travel path to control an actuation state of said switch by selectively shorting the conductive switch terminals; and c) structure for mounting the switch housing in a selected one of two different orientations on a support surface comprising:

i) a retainer coupled to the switch housing having a retaining surface spaced from one wall of the switch housing by a gap that permits the retainer to slide over a tab coupled to the support surface to which the switch housing is mounted; and ii) a latch member attached to the retainer by a flexible connection that permits the latch member to flex as the retainer is pushed over the tab; said latch member having a projection that fits into an opening in the tab for inhibiting further relative movement between the tab and the switch housing in one of said two orientations.

2. The switch apparatus of claim 1 wherein the latch member comprises an elongated finger which supports the projection and that is spaced on either side by first and second walls of said latch member that extend out from said one wall of the switch housing to space the elongated finger from the switch housing by a width of said first and second walls.

3. The switch apparatus of claim 2 wherein the projection has a plateau and first and second ramp sections raised above a planar portion of the latch that seats within the opening in only one of two orientations.

4. The apparatus of claim 3 additionally comprising a support for the switch having a planar portion with a hole extending through the planar portion and wherein the hole defines a "T" shaped opening and wherein the ramp sections of the projection fit within side lobes of the "T" shaped opening.

5. Switch apparatus comprising:

a) a switch housing supporting conductive switch contacts within a switch housing interior;

b) a switch actuator that extends through a side wall of the switch housing and is supported by the switch housing for movement along a travel path to control an actuation state of said switch by selectively shorting the conductive switch contacts;

c) a mounting tab connected to a mounting surface for supporting the switch housing including a first tab portion having a generally planar surface for attachment to the mounting surface, a second tab portion spaced from the mounting surface, and an intermediate tab portion connecting the first and second tab portions; said second tab portion defining a depression in a surface of said second tab portion; and d) a housing support for mounting the switch housing in a selected one of two different orientations on a support surface comprising:

i) a retainer coupled to the switch housing having a retaining surface spaced from one wall of the switch housing by a gap that permits the retainer to slide over the tab coupled to the support surface to which the switch housing is mounted; and ii) a latch member attached to the retainer by a flexible connection that permits the latch member to flex as the retainer is pushed over the tab; said latch member having a projection coupled to the latch member that fits into the depression within the tab for inhibiting further relative movement between the tab and the switch housing in one of said two orientations.

6. Switch apparatus comprising:

a) a switch housing having elongated side walls and an end wall that defines a housing interior;

b) conductive switch terminals supported within the housing interior and extending outside the switch housing for connection to an external circuit;

c) a switch actuator that extends through the end wall of the switch housing and is supported by the switch housing for movement along a travel path to control an actuation state of said switch by selectively shorting the conductive switch terminals; and d) a housing cover that encloses the housing interior and includes openings to allow the terminals to extend from the housing interior to connect to the external circuit; said cover having structure for mounting the switch housing in a selected one of two different orientations on a support surface comprising:

i) a retainer coupled to the housing cover having a retaining surface spaced from one wall of the housing cover by a gap that permits the retainer to slide over a tab coupled to the support surface to which the switch housing is mounted; and ii) a latch member attached to the retainer by a flexible connection that permits the latch member to flex as the retainer is pushed over the tab; said latch member having a projection coupled to the latch member that fits into an opening in the tab for inhibiting further relative movement between the tab and the switch housing in one of said two orientations.

7. The switch apparatus of claim 6 wherein the latch member comprises an elongated finger which supports the projection and that is spaced on either side by first and second walls of said latch member that extend out from said one wall of the housing cover to space the elongated finger from the housing cover by a width of said first and second walls.

8. A method of mounting a switch in one of two orientations that allow actuation of a switch actuator from one of two opposite directions comprising the steps of:

a) mounting switch contacts in a switch housing that has a slot open at either end to allow the switch housing to be mounted onto a tab; said housing including a flexible latch which bounds the slot and defines an projection that is symmetric about one dimension of the projection and is asymmetric about a second dimension of the projection;

b) providing a mounting tab dimensioned to fit into the slot in the housing and that includes an opening extending through the tab so that as the housing is pushed over the tab the projection seats within the opening when the housing is properly aligned; and c) pushing the housing over the tab until the projection seats within the opening in the mounting tab.

* * * * *